US009887022B2

(12) United States Patent
Schill et al.

(10) Patent No.: US 9,887,022 B2
(45) Date of Patent: Feb. 6, 2018

(54) STRANDED CONDUCTORS AND METHOD FOR PRODUCING STRANDED CONDUCTORS

(71) Applicant: LEONI KABEL HOLDING GMBH, Nuremberg (DE)

(72) Inventors: Markus Schill, Munich (DE); Yuecel Sahiner, Nuremberg (DE); Wolfgang Stadler, Hilpoltstein (DE)

(73) Assignee: LEONI Kabel Holding GmbH, Nuremberg (DE)

( * ) Notice: Subject to any disclaimer, the term of this patent is extended or adjusted under 35 U.S.C. 154(b) by 0 days.

(21) Appl. No.: 15/146,009

(22) Filed: May 4, 2016

(65) Prior Publication Data

US 2016/0247602 A1 Aug. 25, 2016

Related U.S. Application Data

(63) Continuation of application No. PCT/EP2014/073973, filed on Nov. 6, 2014.

(30) Foreign Application Priority Data

Nov. 6, 2013 (DE) ..... 10 2013 222 529

(51) Int. Cl.
*H01B 3/30* (2006.01)
*H01B 3/44* (2006.01)
(Continued)

(52) U.S. Cl.
CPC ..... *H01B 7/04* (2013.01); *H01B 7/0009* (2013.01); *H01B 13/0036* (2013.01); *H01B 13/02* (2013.01); *H01B 13/06* (2013.01)

(58) Field of Classification Search
CPC .. C22C 9/00; C22C 9/02; C22C 21/00; C22C 21/08; C22F 1/04; C22F 1/05; C22F 1/08;
(Continued)

(56) References Cited

U.S. PATENT DOCUMENTS 6,307,156 B1 10/2001 Avellanet
8,822,827 B2 * 9/2014 Amils ..... H01B 5/104 174/128.1
(Continued)

FOREIGN PATENT DOCUMENTS

CN 2847464 Y 12/2006
CN 201413657 Y 2/2010
(Continued)

*Primary Examiner* — Timothy Thompson
*Assistant Examiner* — Guillermo Egoavil
(74) *Attorney, Agent, or Firm* — Laurence A. Greenberg; Werner H. Stemer; Ralph E. Locher

(57) ABSTRACT

A stranded conductor contains a number of individual wires. The multiple identically designed individual wires are arranged about a central inner wire as outer wires. The individual wires form a composite which is encased by insulation, and the outer wires are uncompressed and have a non-round cross-section such that when seen in cross-section, the outer wires expand radially outwards starting from the inner wire. The composite of individual wires is not compressed such that the composite has a high alternate bending strength.

17 Claims, 3 Drawing Sheets

(51) Int. Cl.

| | |
|---|---|
| ***H01B 7/295*** | (2006.01) |
| ***H01B 7/04*** | (2006.01) |
| ***H01B 7/00*** | (2006.01) |
| ***H01B 13/00*** | (2006.01) |
| ***H01B 13/02*** | (2006.01) |
| ***H01B 13/06*** | (2006.01) |

(58) Field of Classification Search

CPC . D07B 1/147; D07B 2205/2071; F21S 4/002; F21S 4/10; F21S 4/15; F21V 23/001; F21W 2121/04; H01B 1/023; H01B 1/026; H01B 3/025; H01B 3/445; H01B 5/00; H01B 5/08; H01B 7/04; H01B 7/14; H01B 7/0009; H01B 7/30; H01B 7/303; H01B 9/00; H01B 9/006; H01B 11/06; H01B 13/02; H01B 13/06; H01B 13/0036; H02G 9/00

USPC ..... 174/37, 110 R, 113 C, 113 R, 115, 130; 362/249.16

See application file for complete search history.

(56) References Cited

U.S. PATENT DOCUMENTS

| | | | | |
|---|---|---|---|---|
| 2007/0187132 | A1* | 8/2007 | Watt | H01B 11/06 174/113 R |
| 2010/0018745 | A1 | 1/2010 | Tsukamoto et al. | |
| 2010/0071458 | A1* | 3/2010 | Wiedenhoefer | F01C 1/107 73/253 |
| 2012/0217060 | A1 | 8/2012 | Kusakari et al. | |
| 2013/0264093 | A1* | 10/2013 | Fontana | H01B 3/445 174/113 R |
| 2013/0284481 | A1* | 10/2013 | Miramonti | H01B 9/006 174/37 |
| 2014/0345905 | A1* | 11/2014 | Morice | H01B 13/0016 174/113 R |
| 2015/0078000 | A1* | 3/2015 | Chen | F21S 4/002 362/249.16 |

FOREIGN PATENT DOCUMENTS

| | | | | | |
|---|---|---|---|---|---|
| CN | 201741464 | U | | 2/2011 | |
| CN | 201956085 | U | * | 8/2011 | H01B 5/08 |
| CN | 102360588 | A | * | 2/2012 | H01B 9/00 |
| CN | 202275607 | U | | 6/2012 | |
| CN | 202871327 | U | | 4/2013 | |
| CN | 203013375 | U | | 6/2013 | |
| DE | 112010004176 | T5 | | 12/2012 | |
| GB | 1336200 | A | | 11/1973 | |
| JP | 2008166141 | A | | 7/2008 | |
| JP | 2009016088 | A | | 1/2009 | |
| KR | 20130118097 | A | | 10/2013 | |

* cited by examiner

STRANDED CONDUCTORS AND METHOD FOR PRODUCING STRANDED CONDUCTORS

CROSS-REFERENCE TO RELATED APPLICATION

This is a continuation application, under 35 U.S.C. §120, of copending international application No. PCT/EP2014/073973, filed Nov. 6, 2014, which designated the United States; this application also claims the priority, under 35 U.S.C. §119, of German patent application No. DE 10 2013 222 529.6, filed Nov. 6, 2013; the prior applications are herewith incorporated by reference in their entirety.

BACKGROUND OF THE INVENTION

Field of the Invention

The invention relates to a stranded conductor containing a number of individual wires, wherein multiple individual wires that are embodied in an identical manner are arranged as outer wires around a central inner wire and wherein the individual wires form a composite that is encased by insulation. Furthermore, the invention relates to a method for producing a corresponding stranded conductor.

If multiple individual wires having a round cross section are arranged as outer wires around a central inner wire having a likewise round cross section so as to form a stranded conductor, when viewed in the cross section, wedge-shaped free spaces, herein under described as wedges, are thus formed on the circumferential side between the outer wires and a circular circumferential line. If an individual wire composite of this type is provided with an insulating synthetic material sheathing by way of example by an extrusion procedure, the wedges are thus also filled with the raw material of the synthetic material sheathing. Consequently, the weight of the synthetic material sheathing of a stranded conductor of this type depends upon the number and the size of each wedge on the circumferential side.

In some application fields, such as by way of example in the automobile industry, as light as possible a weight is desired or required for the stranded conductors that are used, which is why in these cases the aim is to achieve a cross section for the stranded conductor that is as close as possible to circular and accordingly contains as few as possible wedges that are also as small as possible. It is known for producing a stranded conductor of this type initially to arrange multiple individual wires having a round cross section around a central individual wire having a likewise round cross section and to subsequently compact this arrangement. Within the scope of this compacting procedure, the individual wires are deformed and the cross section of this individual wire composite takes on the form of an almost circular shape when a corresponding uniform pressure is exerted over the circumference. A compacted stranded wire of this type is by way of example disclosed in German patent DE 11 2010 004 176 T5 (corresponding to U.S. patent publication No. 2012/0217060) or also British patent GB 1 336 200 B.

As a consequence of this mechanical pressure treatment of the individual wire composite, the mechanical characteristics of the individual wires change so that an after-treatment, by way of example an annealing procedure, is required as an additional process step. In addition, the so-called fatigue strength under reverse bending stresses is reduced as a result of the compacting procedure.

SUMMARY OF THE INVENTION

On this basis, the object of the invention is to provide a compact stranded conductor having good fatigue strength under reverse bending stresses and also a method for producing a stranded conductor of this type.

This object is achieved in accordance with the invention by means of a stranded conductor and also by means of a method. Preferred further developments are included in the related claims. The advantages and preferred embodiments regarding the stranded conductor can similarly be transferred to the method and vice versa.

A corresponding stranded conductor contains a plurality of individual wires, wherein multiple individual wires that are embodied in an identical manner are arranged as outer wires around a central inner wire and wherein the individual wires form an individual wire composite or, in short, a composite that is encased by an insulation. Outer wires having a non-round cross section are used as outer wires, wherein the width of the outer wires from the inner wire radially outwards increases when viewed in the cross section. In other words, the individual wires that are specified as outer wires for a corresponding stranded conductor are prefabricated having a non-round cross section and are arranged as such in particular around a central inner wire or around an inner layer of individual wires so as to form the stranded conductor and consequently are wrapped with a pre-formed non-round cross section.

The individual wire composite and consequently also outer wires of the stranded conductor are not compacted in the completed stranded conductor, and are in other words also not subsequently deformed by a compacting procedure or by compacting the individual wire composite from the original round individual wires into the non-round geometric shape. The non-round cross section of the outer wires is selected in such a manner that as much as possible of the room or space that is provided is completely used and that the cross section of the individual wire composite is as circular as possible at least in the circumferential region. As a consequence, the wedges that remain on the circumferential side are at least clearly reduced in comparison to the round individual wires.

Since the individual wire composite is not compacted and consequently not subjected to any subsequent compacting procedure and therefore not subjected to a cold-forming procedure, an annealing procedure that is usually performed for the individual wire composite in the case of a compacting procedure can be omitted when producing the stranded conductor so that the production process is accordingly less complex. In addition, such a non-compacted composite of individual wires contains a high fatigue strength which is advantageous for a plurality of applications. The term a "high fatigue strength" or "fatigue strength under reverse bending stresses" is understood to mean that the stranded conductor withstands relatively many reverse bending processes, in other words displays few signs of fatigue when influenced in a reverse bending manner. For an in-depth explanation of this term, reference is to be made to the ASTM B470 and the publication "Schymura M. A., Fischer A.: Beitrag zur Untersuchung der Ermüdungseigenschaften dünner Drähte aus Kupferbasiswerkstoffen unter Biegewechselbeanspruchung nach ASTM B470-02. Metall, 66, 11 (2012), S.514-517, ISSN 0026-0746" [Schymura M. A., Fischer A.: Contribution to the Analysis of Fatigue Characteristics of Copper-based Thin Wires under Reverse Bending Stresses according to ASTM B470-02. Metal 66, 11 (2012) cf. 514-517, ISSN 0026-0746].

This high fatigue strength in comparison to compacted stranded conductors is achieved simply by omitting the compacting step and the simultaneous use of non-round individual wires in the initial state prior to the stranding procedure. The individual wires lie namely—in comparison to compacted stranded conductors—comparatively loose against one another so that the individual wires can move relative to one another in a low friction manner. In contrast thereto, the individual wires in the case of the compacted stranded conductor are deformed by the compacting procedure in such a manner that the wires are pressed flat against one another and as a consequence are almost meshed to one another on their surfaces. Simultaneously, the advantage of compacted stranded conductors is maintained, namely to achieve an as round as possible outer cross section of the strand so that only a small and as homogeneous as possible wall thickness of the (wire) insulation is rendered possible.

A stranded conductor of this type is in particular used as a super-thin line, in particular vehicle line.

The number of individual wires that are arranged around a central inner wire as outer wires is advantageously adjusted to suit the respective intended application. In the case of a two-layer stranded conductor having a central inner wire and an outer layer of outer wires, the stranded conductor is preferably embodied from the one inner wire and six outer wires. In the case of stranded conductors having multiple outer layers, at least the outermost layer is formed from the outer wires having the non-round cross section. The outer wires indirectly surround in this case the inner wire by interpositioning one or multiple intermediate layers of individual wires that are embodied as round or are preferably embodied in a similar manner to the outermost wires as non-round.

As mentioned above, the pre-formed individual wires contain cross-sectional shapes of the type that the cross section of the individual wire composite is as round as possible and consequently is as close to circular as possible. In the simplest case, a cross-sectional shape that is at least approximately a triangular cross-sectional shape is selected, wherein the shape of an equilateral triangle is preferred. In the individual wire composite, the outer wires are then arranged in such a manner that, when viewed in the cross section, a corner of one of each outer wire points radially inwards in the direction of the inner wire and lies in an almost punctiform manner on the inner wire or on the individual wire of the intermediate layer. Essentially, a punctiform contact arrangement is consequently achieved between the outer wires and the inner wire owing to which a high flexibility and high fatigue strength of the individual wire composite and lastly also of the stranded conductor is provided. In contrast, in the case of compacted stranded conductors, linear contact zones are formed when viewed in the cross section. In particular, the individual wires are embodied in an approximately trapezoidal manner, wherein in particular the trapezoidal surface that is oriented towards the inner wire is arched in a concave manner and nestles against the curvature of the inner conductor.

Furthermore, a triangular cross-sectional shape is expediently selected for the outer wires and the corners are rounded in said cross-sectional shape. A cross-sectional shape of this type is inter alia easier to achieve.

In an advantageous further development, the sides of the triangular cross section are arched outwards and are consequently embodied in a bow-shaped manner. In this manner, the outer wires make physical contact with one another in an almost punctiform manner which in turn results in a high flexibility and a high fatigue strength of the individual wire composite.

Furthermore, one embodiment of the stranded conductor in which the outer wires comprise a cross section according to a type of a Reuleaux triangle having rounded corners is preferred. A cross-sectional shape that is embodied in this manner is characterized by side surfaces that are arched outwards and also by means of rounded edges. The individual wires thereby lie (when viewed in the cross section) both on the side surfaces as well as also on the corners on adjacent stranded conductors only in a punctiform manner. This embodiment is particularly advantageous with regard to the desired high fatigue strength under reverse bending stresses.

However, a round cross section is preferred for the inner wire.

In accordance with a further advantageous embodiment of the stranded conductor, the outer wires lie essentially in a punctiform manner on the inner wire and are in addition formed and arranged in such a manner that an approximately punctiform contact arrangement is provided between adjacent outer wires. As a consequence, the outer wires together form an outer layer that encases and encloses the inner wire, the outer layer demonstrates an essentially circular circumference when viewed in the cross section. The outer layer is then preferably coated with an insulating sheathing or insulation by way of example of synthetic material, wherein the wall thickness of the insulation is almost uniform owing to the approximately circular circumference of the outer layer when viewed in the circumferential direction.

It is thus possible to achieve a particularly thin wall thickness so that an accordingly embodied stranded conductor contains a relatively low weight and a relatively small required installation space. Corresponding stranded conductors are in particular provided for the motor vehicle industry and accordingly are designed for this intended application. The stranded conductors are in particular super thin vehicle lines, by way of example so-called FLRY lines (nomenclature in accordance ISO 6722).

Stranded conductors that are embodied from the central inner wire, multiple, in particular 6, outer wires (1+6 composite) and the insulation are typical and therefore preferred. The outer wires are in other words arranged in a single outer layer around the central inner wire and this outer layer is coated with the thin-walled insulation.

The composite of individual wires advantageously contains a cross-sectional surface area that is smaller than 2.5 $mm^2$ and in particular smaller than 1.5 $mm^2$. Above all, cross-sectional surface areas of 0.35 $mm^2$, 0.75 $mm^2$ and 1 $mm^2$ are particularly widespread and the dimensions are also preferably used in the present case.

The stranded conductor expediently comprises a lay length that preferably amounts to 10 mm to 30 mm. The term "lay length" is to be understood as the axial length of the stranded conductor that is required for a 360° winding of a respective individual wire. In contrast to conventional strands having round individual wires, the lay length is clearly smaller, in particular by approximately the factor of 2. In particular, the lay length is also at least largely independent of the respective diameter of the composite of individual wires. Stranded conductors of different diameters comprise therefore identical or at least comparable lay lengths that lie in the provided region. In the case of conventional composites, the lay lengths vary with the diameters. Tests have found that these shorter lay lengths are of particular advantage and an undesired twisting of the non-round individual wires around their center axis from the desired rotation orientation is avoided. As a consequence, the defined, desired alignment of the individual wires is ensured in the composite.

On the basis of the proposed basic idea, in other words using pre-formed individual wires having a non-round cross section; it is in addition possible to achieve stranded conductors that comprise multiple layers of outer wires, wherein the individual layers are arranged concentrically with respect to the inner wire. It is also possible in the case of these stranded conductors to achieve a better use of space by means of this concept.

Independent of the number of layers of outer wires, within the scope of producing corresponding stranded conductors initially a prefabrication procedure of the individual wires having a non-round cross section is performed in particular by means of a conventional multi-stage pulling process. The individual wires that are brought into shape in this manner are subsequently subjected to an annealing procedure (soft annealing) in order to ensure the desired resilient bending characteristics of the individual wires. The individual wires are then consequently stranded or wrapped and finally provided with the insulation, wherein by way of example an extruder of a stranding machine is connected directly downstream. A compacting procedure of the individual wires or the composite of individual wires and also a further annealing procedure is not performed after the stranding procedure.

Other features which are considered as characteristic for the invention are set forth in the appended claims.

Although the invention is illustrated and described herein as embodied in a stranded conductors and a method for producing stranded conductors, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
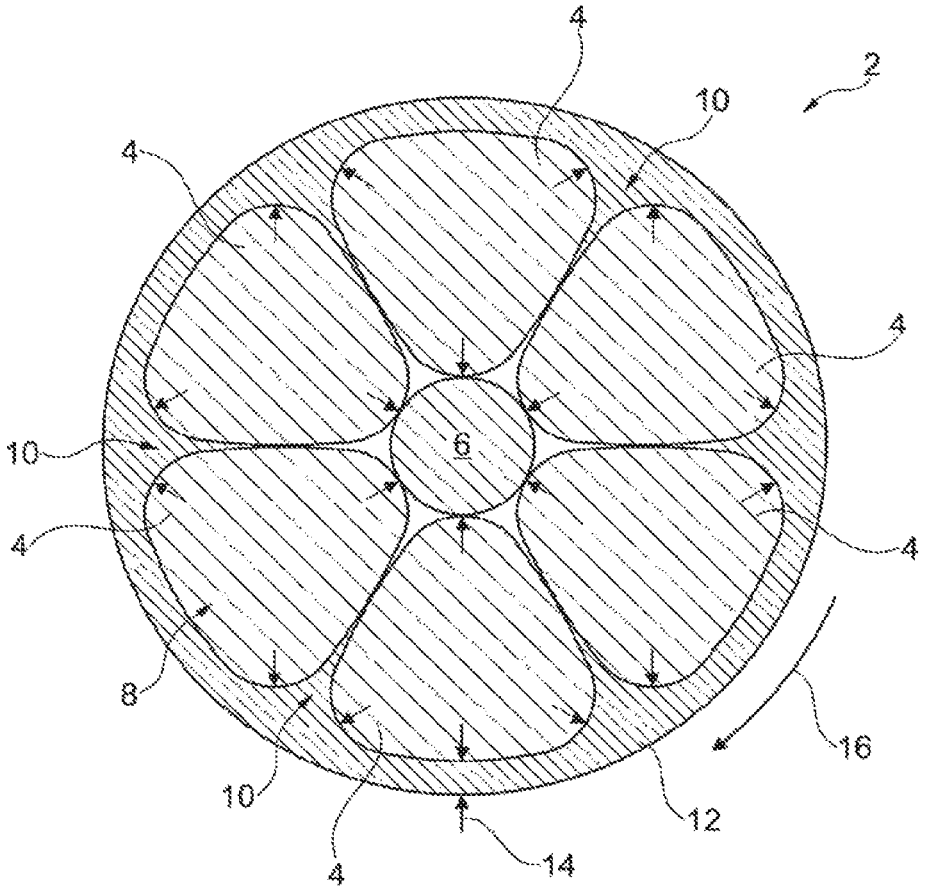
FIG. 1 is a diagrammatic, cross-sectional view of a stranded conductor having an inner wire and multiple outer wires according to the invention.

Parts that correspond to one another are provided in each case with identical reference numerals in all the figures.

Referring now to the figures of the drawings in detail and first, particularly to FIG. 1 thereof, there is shown a stranded conductor 2 that is described herein under in an exemplary manner and is constructed from seven individual wires, wherein six individual wires are arranged as outer wires 4 around a central inner wire 6. The inner wire 6 contains a circular cross section and the outer wires 4 are positioned in a uniformly distributed manner around the inner wire 6.

Figure 2:
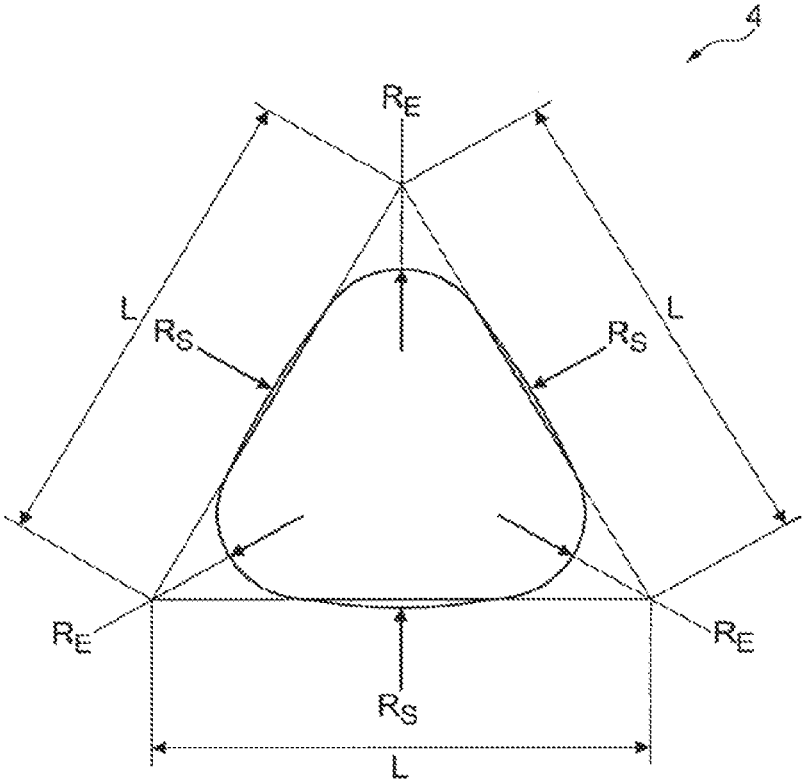
FIG. 2 is an enlarged cross-sectional view of one of the outer wires.

The outer wires 4 are embodied in an identical manner and comprise a cross section that has a shape that is very close to the shape of a Reuleaux triangle with rounded corners. This cross-sectional shape is illustrated in an enlarged manner in FIG. 2 and is illustrated for the purposes of comparison together with an equilateral triangle having a side length L. In this manner it is evident that the cross section of the outer wires 4 comprises rounded corners based on a triangular form. In addition, the sides are arched outwards.

In other words, the cross-sectional shape of the outer wires 4 is constructed from two different circle segment shapes, wherein the corners of the Reuleaux triangular shape in each case are formed by a circle segment shape having a radius RE and wherein the sides of the Reuleaux triangular shape are formed in each case by a circle segment shape having a radius RS.

In the case of a stranded conductor 2 for ultra-thin vehicle lines, the side length L lies by way of example in the range of 0.25 mm-0.6 mm, in particular approximately 0.4 mm. The radius RS amounts to approximately 10 times the radius RE and lies by way of example at 0.6 mm to 1 mm, in particular 0.8 mm.

The individual wire composite of outer wires 4 and the inner wire 6 is embodied in such a manner that when viewed in the cross section, a corner of each outer wire 4 lies in a punctiform manner against the inner wire 6 and that likewise a punctiform contact arrangement, in other words a punctiform physical contact, is provided between adjacent outer wires 4.

The outer wires 4 together form a closed outer layer 8 by which the inner wire 6 is entirely enclosed. Furthermore, when viewed in the cross section, the outer layer 8 contains an approximately circular circumference, wherein however a residual wedge 10 is formed in each case in the intermediate region between two outer wires 4 on the circumferential side. However, these wedges 10 are relatively small in comparison to a stranded conductor in accordance with the prior art, wherein outer wires having a circular cross section are arranged around an inner wire having a likewise circular cross section.

The stranded conductor 2 contains in addition an insulation 12 that surrounds the outer layer and is typically applied by an extrusion method. By means of the selected cross-sectional shape of the outer wires 4 and the resultant relatively small size of wedges 10, a wall thickness 14 of the insulation 12 remains approximately uniform when viewed in a circumferential direction 16 and in particular can be very thin.

Figure 3:
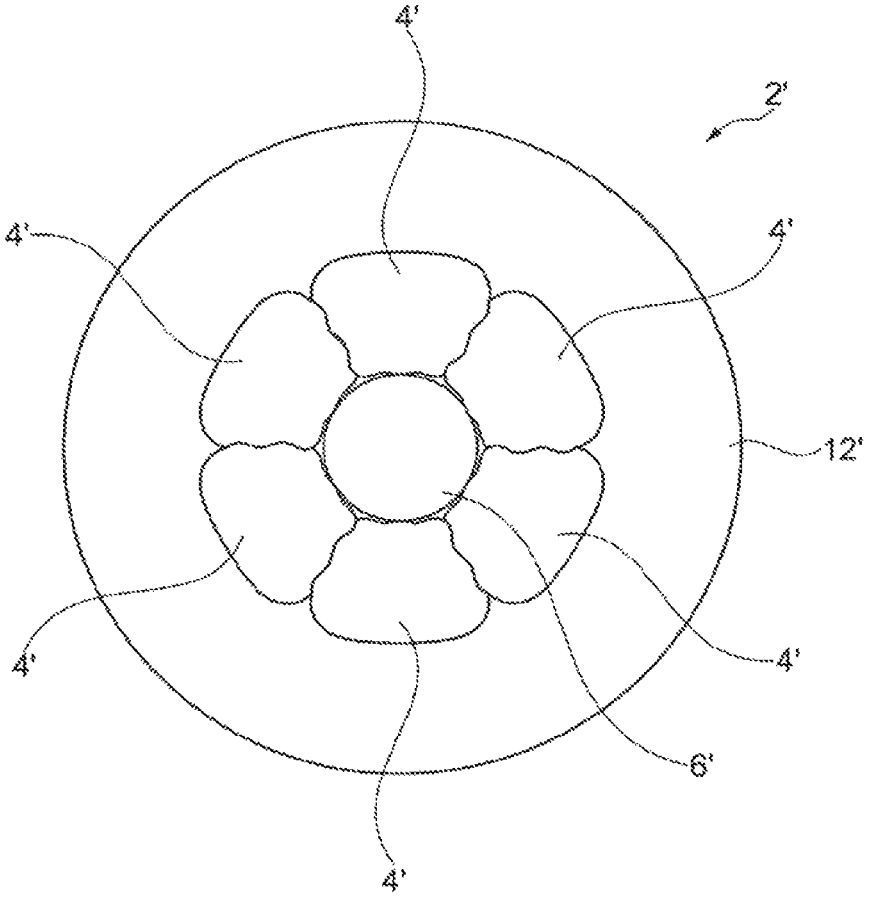
PRIOR ART Fig. 3
FIG. 3 is a cross-sectional view of a stranded conductor having compacted individual wires in accordance with the prior art.

For comparison purposes, FIG. 3 also illustrates a stranded conductor 2' in accordance with the prior art, wherein the individual wire composite has been compacted after stranding the individual wires 4', 6'. The approximately trapezoidal-shaped individual wires 4' do not make physical contact in a punctiform manner but rather contact one another over an extensive surface area. The individual wires 4', 6' appear at first to be almost merged together so that it is not possible to make out the boundaries between the individual wires 4', 6'. This also has an effect on the characteristics of the stranded conductor 2' that inter alia contains a lower fatigue strength than a stranded conductor 2, as is illustrated in FIG. 1.

The invention is not limited to the above described exemplary embodiment. On the contrary, it is possible for the person skilled in the art to also derive other variants of the invention there from without departing from the subject matter of the invention. In particular, in addition, all the individual features that are described in conjunction with the exemplary embodiment can also be combined with one another in other manners without departing from the subject matter of the invention.

The following is a summary list of reference numerals and the corresponding structure used in the above description of the invention:

2 Stranded conductor
4 Outer wire
6 Inner wire
8 Outer layer
10 Wedge
12 Insulation
14 Wall thickness
16 Circumferential direction
2' Stranded conductor in accordance with the prior art
4' Outer wire in accordance with the prior art
6' Inner wire in accordance with the prior art
12' Insulation in accordance with the prior art

The invention claimed is:

1. A stranded conductor, comprising:
insulation; and
a plurality of individual wires including a central inner wire and outer wires being embodied in an identical manner and disposed around said central inner wire, said individual wires forming a composite being encased by said insulation, said outer wires having a non-round cross section and a width which increases from said central inner wire radially outwards when viewed in cross section and said composite of said individual wires is not compacted, wherein in each case two adjacent ones of said outer wires making physical contact with one another only in a punctiform manner and not continuously along adjacent opposite facing side edges.

2. The stranded conductor according to claim 1, wherein said outer wires each have a cross-sectional shape that is triangular.

3. The stranded conductor according to claim 2, wherein said cross-sectional shape of said outer wires has rounded corners.

4. The stranded conductor according to claim 3, wherein said cross-sectional shape of said outer wires contains sides that arch outwards.

5. The stranded conductor according to claim 2, wherein said cross-sectional shape of said outer wires is embodied according to a type of Reuleaux triangle in which corners are rounded.

6. The stranded conductor according to claim 1, wherein said outer wires in each case make physical contact with said central inner wire in a punctiform manner.

7. A stranded conductor, comprising:
insulation;
a plurality of individual wires including a central inner wire and outer wires being embodied in an identical manner and disposed around said central inner wire, said individual wires forming a composite being encased by said insulation, said outer wires having a non-round cross section and a width which increases from said central inner wire radially outwards when viewed in cross section and said composite of said individual wires is not compacted;
said outer wires each having a cross-sectional shape that is triangular;
said cross-sectional shape of said outer wires having rounded corners; and
said cross-sectional shape of said outer wires containing sides that arch outwards.

8. The stranded conductor according to claim 1, wherein said central inner wire has a round cross section.

9. The stranded conductor according to claim 1, wherein six of said outer wires are disposed around said central inner wire.

10. The stranded conductor according to claim 1, wherein said outer wires together form an outer layer that is covered by said insulation, wherein a wall thickness of said insulation remains uniform when viewed in a circumferential direction.

11. The stranded conductor according to claim 1, wherein said outer wires are disposed in a single outer layer around said central inner wire and wherein said outer layer is covered by said insulation.

12. The stranded conductor according to claim 1, wherein said composite of said individual wires has a cross-sectional surface area that is smaller than 2.5 $mm^2$.

13. The stranded conductor according to claim 1, wherein said individual wires have a lay length in a range of 10-30 mm, wherein the lay length is independent of a diameter of said composite of said individual wires.

14. The stranded conductor according to claim 1, wherein said composite of said individual wires has a cross-sectional surface area that is smaller than 1.5 $mm^2$.

15. A method for producing a stranded conductor, which comprises the steps of:
disposing a plurality of individual wires being outer wires around an individual wire being a central inner wire so that the individual wires and the central inner wire form a composite of wires, the outer wires having a non-round cross section, a width of the outer wires increases from the central inner wire radially outwards when viewed in cross section and the composite of wires is left non-compacted, wherein in each case two adjacent ones of the outer wires making physical contact with one another only in a punctiform manner and not continuously along adjacent opposite facing side edges; and
encasing the composite of wires with an insulation.

16. The method according to claim 15, which further comprises:
producing the outer wires having the non-round cross section by means of a pulling procedure;
subjecting the outer wires having the non-round cross section to an annealing procedure after the pulling procedure; and
stranding the outer wires having the non-round cross section after the annealing procedure and are provided with the insulation, wherein a compacting procedure of the individual wires and also a further annealing procedure after the stranding procedure are omitted.

17. The stranded conductor according to claim 1, wherein said outer wires making contact with said central inner wire only in a punctiform manner and not continuously along said opposite side faces.

* * * * *